United States Patent [19]

Oshida

[11] 3,986,898

[45] Oct. 19, 1976

[54] METHOD FOR STRENGTHENING METALLIC MATERIALS LIABLE TO BE SUBJECTED TO INTERNAL OXIDATION

[75] Inventor: Yoshiki Oshida, Yokohama, Japan

[73] Assignee: Mitsubishi Jukogyo Kabushiki Kaisha, Tokyo, Japan

[22] Filed: Mar. 14, 1975

[21] Appl. No.: 558,546

[30] Foreign Application Priority Data

Mar. 18, 1974 Japan ..... 49-30820

[52] U.S. Cl. ..... 148/13.2; 148/16; 148/20.3; 148/131

[51] Int. Cl.[2] ..... C22F 1/08

[58] Field of Search ..... 148/13, 13.1, 13.2, 148/14, 16, 20.3, 131, 134

[56] References Cited

UNITED STATES PATENTS 3,399,086 8/1968 Das et al. ..... 148/13.2

*Primary Examiner*—R. Dean

*Attorney, Agent, or Firm*—Cushman, Darby & Cushman

[57] ABSTRACT

A method for strengthening metallic materials liable to be subjected to internal oxidation, characterized in that said metallic material is strengthened by heating the metallic material liable to be subjected to internal oxidation up to an internal oxidation temperature to cause internal oxidation phenomena to arise, and subjecting said metallic material to a temperature cycle passing over its transformation point to cause superplastic phenomena to arise.

1 Claim, 2 Drawing Figures

METHOD FOR STRENGTHENING METALLIC MATERIALS LIABLE TO BE SUBJECTED TO INTERNAL OXIDATION

The present invention relates to a method for enhancing a strength of metallic materials liable to be subjected to internal oxidation by causing internal oxidation phenomena as well as superplastic phenomena to arise therein.

Heretofore, as a method for enhancing a strength of metallic materials, a cold-work hardening process, a heat-treatment separation hardening process, etc. have been known, and also for the purpose of strengthening complex materials such as FRM, a method in which various oxide powders serving as a strengthening additive are dispersed uniformly in a crystaline structure, has been known. However, every one of these conventional methods had disadvantages that the process was so complexed that the process control was difficult and that a longer processing time was required.

Therefore, it is a principal object of the present invention to eliminate the aforementioned disadvantages in the prior art methods and to provide a working method for enhancing a strength of metallic materials by producing internal oxidation layers within the metallic material and further dispersing the internal oxidation layers uniformly.

Now the method for strengthening metallic materials liable to be subjected to internal oxidation according to the present invention, will be described with reference to the accompanying drawings.

Figure 1:
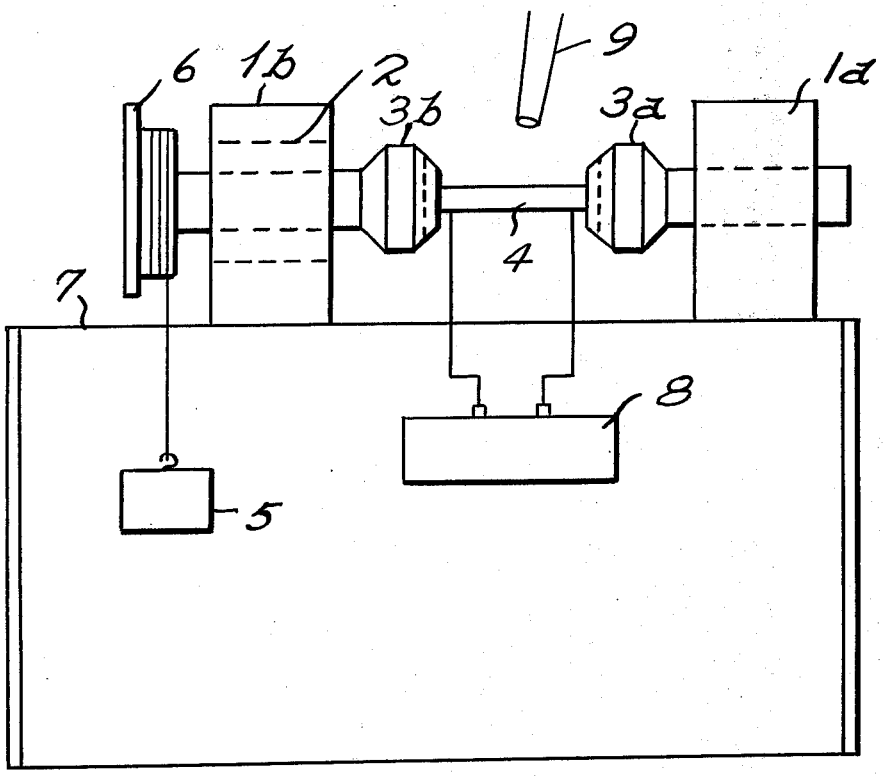
FIG. 1 is a front view showing one preferred embodiment of an apparatus to be used for practicing the present invention.

FIG. 1 shows one example of an apparatus to be used for practicing the present invention, in which a chuck 3*a* supported by a chuck supporting device 1*a* that is slidably mounted on a base frame 7 and another chuck 3*b* rotatably supported by another chuck supporting device 1*b* via a radial bearing 2 are disposed in an opposed relationship, and both the chuck supporting devices 1 *a* and 1*b* can be adjusted in position in accordance with the length of an article 4 to be worked. At the other end of the chuck 3*b* is provided a pulley 6, and there is provided a weight 5 for the purpose of applying a shearing stress to the article 4 to be worked via the pulley 6. The article 4 to be worked is gripped by the chucks 3*a* and 3*b*, and also the article 4 to be worked is connected to a heating electric power supply 8.

However, the chucks 3*a* and 3*b* are electrically insulated from the article 4 to be worked. In addition, a cooling device 9 for cooling said article 4 to be worked is provided.

Figure 2:
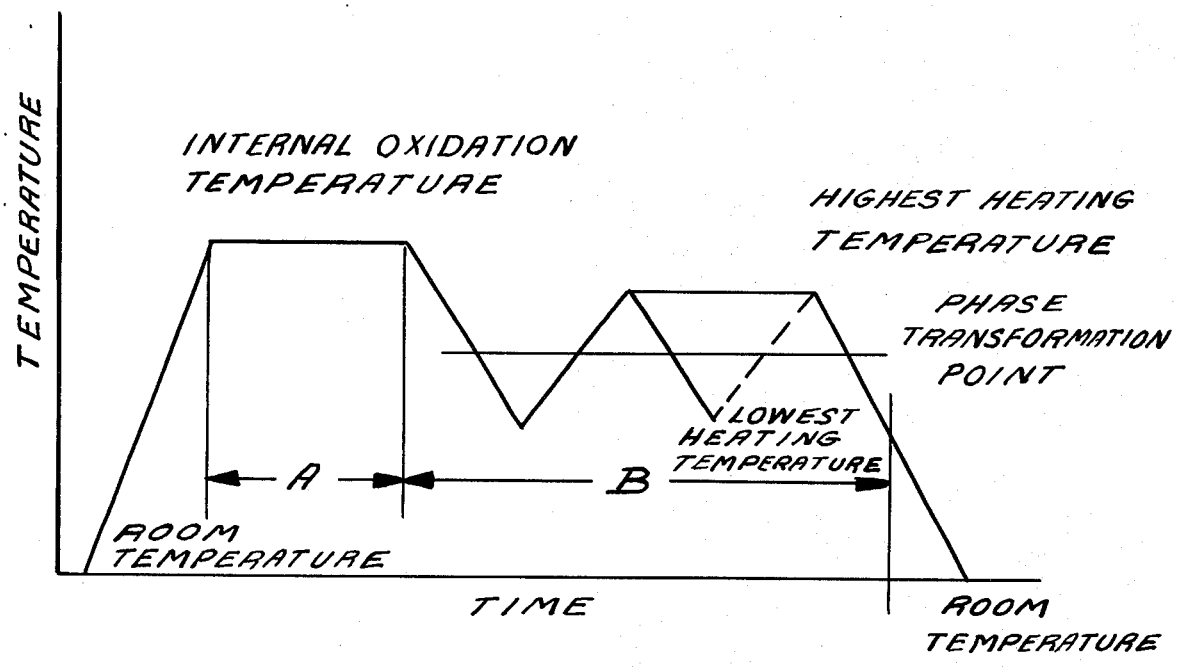
FIG. 2 is a diagram showing the relation between time and temperature.

In the aforementioned apparatus, an article 4 to be worked that is made of a metallic material liable to be subjectd to internal oxidation such as, for example, Cu-15% Si alloy (6 mm in diameter and 130 mm in length), is supported by the chucks 3*a* and 3*b* and the article 4 to be worked is heated up to an internal oxidation temperature of about 900° C for about 1 hour with an electric current fed from the heating electric power supply 8. Thereafter, the weight 5 is hung from the pulley 6 so that a shearing stress of about 4 kg/mm² may be applied to the article, the article 4 to be worked is cooled to about 450° C by means of the cooling device 9, and further it is subjected to temperature cycles for 3 cycles (1 minute/cycle) over a temperature range of ±100° C about the phase transformation temperature of 558° C (a transformation point of $K \leftrightarrows \alpha + \gamma$) of the article 4 to be worked. The abovedescribed relation between time and temperature is illustrated in FIG. 2. In the time interval A occurs internal oxidation. While external oxidation could be prevented by means of an inert gas and the like, generally the amount of the external oxidation is extremely small in comparison to the internal oxidation. Further in the time interval B, as a result of application of the temperature cycles, the internal oxidation layers are uniformly dispersed over the entire metallurgical structure, and simultaneously therewith fining of crystal grains occurs due to transformation superplastic phenomena, so that the internal oxidation layers are dispersed uniformly into the interstices between fine crystal grains, and the structure appears as if it is of dispersion-strengthened type.

While the processing time for internal oxidation was selected at about one hour in the aforementioned exammple, said processing time could be selected at any appropriate value depending upon the metallic material and the thickness of the internal oxidation layers.

Comparing the mechanical strength of the article to be worked employed in the above example between before the processing and after the processing, the following values are obtained:

| | Tensile Strength (kg/mm²) | Elongation (%) | Contraction (%) |
|---|---|---|---|
| Before Processing | 58 | 13 | 59 |
| After Processing | 72 | 15 | 63 |

It is to be noted that while the upper and lower limits of the temperature range were selected at about ±100° C relative to the transformation point and the frequency was selected at 1 cycle per minute in the aforementioned example, these values have been determined taking into consideration the variation of the transformation point caused by change of the heating and cooling speeds as well as the time required for commencement and termination of a transformation. These processing conditions are selected at appropriate values depending upon the nature and shape of the material, and also the processing time for internal oxidation is selected at an appropriate value depending upon the desired thickness of the internal oxidation layers. In addition, the shearing stress is selected at about 1/10 – 1/20 of the yielding point stress of the unprocessed material. The lower limit of the aforementioned range is a stress necessitated for producing super-plastic phenomena, while the upper limit is a stress that would not deform the article to be worked.

Besides the above-referred Cu—Si alloy, CuAl, Cu—Zn—Al, Cu—Be or Fe—Al, Fe—Cr, Fe—V, Fe—Si, Ni—Cr, etc. are the representative metallic materials which are liable to be subjected to internal oxidation, and in summary, if a minute additive alloy element has a larger affinity to oxygen than a base metal (Cu, Fe or Ni), then generally internal oxidation is liable to occur.

By making use of the internal oxidation phenomena and also by applying a stiffening treatment, fining of crystal grains as well as equalizing of a metallurgical structure are produced and the internal oxidation layers are uniformly dispersed into the interstices between the crystal grains.

According to the present invention, so long as a material is a metallic material liable to be subjected to internal oxidation, after processing the material has a strong resistance against degradation of a mechanical strength at a raised temperature, it can be used even at a temperature higher than its limit temperature for use, it is excellent in thermal conductivity and it is given with a sufficient mechanical strength. In addition, the internal oxidation treatment and the stiffening treatment can be practiced in one process, so that the process is simplified and the working efficiency is improved.

In summary, according to the present invention, a metallic material liable to be subjected to internal oxidation is strengthened by heating said metallic material up to its internal oxidation temperature to generate the internal oxidation phenomena and further by subjecting said metallic material to temperatue cycles passing over its transformation point to generate the superplastic phenomena, and thereby a strong and stiff metallic material in which internal oxidation has occurred, can be easily obtained. Therefore, the invention is industrially useful.

What is claimed is:

1. A method for strengthening metallic articles, comprising:

heating a metallic material in the form of an article to the internal oxidation temperature of that metallic material, wherein said metallic material is a copper-silicon alloy which contains 15% silicon and wherein said internal oxidation temperature is about 900° C;

subjecting the metallic material to a shearing stress of about 1/10 to 1/20 of the yielding point stress of the unprocessed material;

cooling the metallic material to about 450° C; and subjecting said metallic material to a heat treatment, which is at a temperature ranging from ± 100° C of the phase transformation temperature of 558° C of said material, wherein said heat-treating is undertaken in three cycles.

* * * * *